US008853596B2

(12) United States Patent
Izume

(10) Patent No.: US 8,853,596 B2
(45) Date of Patent: Oct. 7, 2014

(54) MANUFACTURING DEVICE FOR MACHINE PLATE FOR PRINTER

(76) Inventor: Masayuki Izume, Kyoto (JP)

( * ) Notice: Subject to any disclaimer, the term of this patent is extended or adjusted under 35 U.S.C. 154(b) by 835 days.

(21) Appl. No.: 12/737,199

(22) PCT Filed: May 21, 2009

(86) PCT No.: PCT/JP2009/059312

§ 371 (c)(1),
(2), (4) Date: May 6, 2011

(87) PCT Pub. No.: WO2010/001667

PCT Pub. Date: Jan. 7, 2010

(65) Prior Publication Data

US 2011/0210111 A1 Sep. 1, 2011

(30) Foreign Application Priority Data

Jul. 1, 2008 (JP) ..... 2008-172065

(51) Int. Cl.
*B21J 5/06* (2006.01)
*B41F 27/02* (2006.01)
*B41F 27/12* (2006.01)

(52) U.S. Cl.
CPC ..... *B41F 27/1262* (2013.01); *B41F 27/02* (2013.01)
USPC ..... 219/153; 72/51; 72/52; 72/367.1; 72/368; 72/389.3; 29/888.06; 29/888.061; 29/888.07; 29/888.08; 29/888.09; 29/888.091; 101/389.1; 101/415.1

(58) Field of Classification Search
CPC ..... B21D 5/02; B21J 5/06; B41F 27/1262; B41F 27/00–27/14
USPC ..... 72/51, 52, 367.1, 368, 389.3, 380; 29/888.06–888.4; 101/415.1, 389.1; 219/153
See application file for complete search history.

(56) References Cited

U.S. PATENT DOCUMENTS 2,756,346 A * 7/1956 Victoreen ..... 250/376
3,017,545 A 1/1962 Meier (Continued)

FOREIGN PATENT DOCUMENTS

DE 8436119 U1 1/1986
DE 102005021461 A1 * 11/2006

(Continued)

OTHER PUBLICATIONS

Supplementary European Search Report dated Apr. 12, 2012, issued for the corresponding European Patent Application No. 09 77 3245.7.

(Continued)

*Primary Examiner* — Dana Ross
*Assistant Examiner* — Brett Spurlock
(74) *Attorney, Agent, or Firm* — Edwards Wildman Palmer LLP; James E. Armstrong, IV; George N. Chaclas

(57) ABSTRACT

A machine-plate manufacturing device 30 includes a cylinder section 32 having an outer circumferential portion. A groove into which an engagement portion of the sheet is removably inserted is formed in the outer circumferential portion of the cylinder section 32. On the inner side of the outer circumferential portion of the cylinder section 32, magnetic attraction members 51 formed of a magnetic material are provided, and permanent magnets 53 are provided in such a manner that their orientation can be switched. Permanent-magnet switching means is provided to switch the orientation of the permanent magnets 53 between a magnetization position for magnetizing the magnetic attraction members 51 and a demagnetization position for demagnetizing the magnetic attraction members 51.

16 Claims, 11 Drawing Sheets

(56) References Cited

U.S. PATENT DOCUMENTS

| | | | | | |
|---|---|---|---|---|---|
| 3,097,598 | A | * | 7/1963 | Masjoshusmann et al. | 101/378 |
| 3,728,881 | A | * | 4/1973 | Coop | 72/52 |
| 3,824,926 | A | * | 7/1974 | Fukuyama | 101/378 |
| 3,885,498 | A | * | 5/1975 | Jenkins | 101/389.1 |
| 3,919,937 | A | * | 11/1975 | Kostal | 101/378 |
| 3,973,098 | A | * | 8/1976 | Harris | 219/153 |
| 4,175,228 | A | * | 11/1979 | Bizzari et al. | 219/153 |
| 4,453,468 | A | * | 6/1984 | Shenoha | 101/389.1 |
| 4,625,928 | A | * | 12/1986 | Peekna | 242/430 |
| 4,628,815 | A | * | 12/1986 | Van Kanegan | 101/415.1 |
| 4,676,161 | A | * | 6/1987 | Peekna | 101/378 |
| 4,732,026 | A | * | 3/1988 | Ban | 72/52 |
| 4,811,474 | A | * | 3/1989 | Maucher et al. | 29/446 |
| 4,823,697 | A | | 4/1989 | Randazzo | |
| 4,920,630 | A | * | 5/1990 | Leanna | 29/521 |
| 5,224,423 | A | * | 7/1993 | Borel | 101/415.1 |
| 5,711,223 | A | | 1/1998 | Taylor | |
| 5,836,189 | A | * | 11/1998 | Streubel et al. | 72/51 |
| 5,992,727 | A | | 11/1999 | Hoffmann et al. | |
| 6,032,565 | A | * | 3/2000 | Okonski et al. | 83/522.15 |
| 6,076,444 | A | * | 6/2000 | Okonski | 83/99 |
| 6,357,354 | B1 | | 3/2002 | Dauer et al. | |
| 6,457,410 | B1 | * | 10/2002 | Zerillo | 101/389.1 |
| 6,532,854 | B2 | * | 3/2003 | Okonski et al. | 83/698.41 |
| 6,688,227 | B2 | * | 2/2004 | Zerillo | 101/389.1 |
| 7,430,890 | B1 | * | 10/2008 | Battaglia | 72/368 |
| 2003/0188652 | A1 | * | 10/2003 | Mclean et al. | 101/450.1 |
| 2005/0118524 | A1 | * | 6/2005 | McLean et al. | 430/199 |
| 2005/0186510 | A1 | * | 8/2005 | McLean et al. | 430/302 |

FOREIGN PATENT DOCUMENTS

| | | | |
|---|---|---|---|
| JP | 10-258585 | A | 9/1998 |
| JP | 2000-103036 | | 4/2000 |
| JP | 2009-285861 | A | 12/2009 |

OTHER PUBLICATIONS

International Search Report for International Application No. PCT/JP2009/059312 issued Jun. 23, 2009.

* cited by examiner

MANUFACTURING DEVICE FOR MACHINE PLATE FOR PRINTER

TECHNICAL FIELD

The present invention relates to a manufacturing device for a machine plate for a printer (hereinafter may be referred to as a "printer machine plate").

BACKGROUND ART

There is known a printer in which a machine plate is mounted on the outer circumference of a machine-plate cylinder fixed on a machine-plate drive shaft.

SUMMARY OF THE INVENTION

Problems to be Solved by the Invention

In the above-mentioned printer, a sheet-like machine plate may be wound onto a machine-plate cylinder fixed on a machine-plate drive shaft. In such a case, mounting the machine plate within the printer is troublesome, and difficulty is encountered in accurately attaching the machine plate to the machine-plate cylinder.

In order to avoid such difficulty, the sheet-like machine plate may be wound onto the machine-plate cylinder while the machine-plate cylinder is detached from the machine-plate drive shaft, followed by fixation of the machine-plate cylinder on the machine-plate drive shaft. In this case, since the machine-plate cylinder is considerably heavy, difficulty is encountered in detaching and attaching the machine-plate cylinder from and to the machine-plate drive shaft.

The present inventor has proposed a machine plate for a printer which solves the above-described problem and which can be readily and accurately attached to the printer (Japanese Patent Application No. 2008-137766). The machine plate is formed as follows. A rectangular sheet of a magnetic material having elasticity is formed into a cylindrical shape with opposite end portions of the sheet superposed on each other and joined together to form a joint portion whereby a cylindrical machine-plate body is formed; an end portion of the sheet located on the inner side of the joint portion is bent inward whereby an engagement portion is formed; and a forme area is provided at a predetermined portion of the outer circumferential surface of the machine-plate body excluding the joint portion.

An object of the present invention is to provide a manufacturing device for a printer machine plate (hereinafter referred to as a "printer-machine-plate manufacturing device") which facilitates manufacture of a cylindrical printer machine plate as described above.

Means for Solving the Problems

A printer-machine-plate manufacturing device according to the present invention is adapted to manufacture a printer machine plate configured such that a rectangular sheet of a magnetic material having elasticity is formed into a cylindrical shape with opposite end portions of the sheet superposed on each other and joined together to form a joint portion whereby a cylindrical machine-plate body is formed; an end portion of the sheet located on the inner side of the joint portion is bent inward whereby an engagement portion is formed; and a forme area is provided at a predetermined portion of the outer circumferential surface of the machine-plate body excluding the joint portion. The manufacturing device comprises a cylinder section having an outer circumferential portion around which the sheet is wound and which has, on its outer circumference, a groove into which the engagement portion of the sheet is removably inserted from its distal end. On the inner side of the outer circumferential portion of the cylinder section, a magnetic attraction member formed of a magnetic material is provided, and a permanent magnet is provided in such a manner that its position can be switched. Further, permanent-magnet switching means is provided in order to switch the position of the permanent magnet between a magnetization position for magnetizing the magnetic attraction member and a demagnetization position for demagnetizing the magnetic attraction member.

Herein, the term "forme area" means an area where a forme is already formed (processed area), as well as an area where a forme is to be formed and is not yet formed (area to be processed).

The machine plate manufactured by use of the device according to the present invention is mounted on a machine-plate mounting device of a printer for use thereof. For example, the machine-plate mounting device comprises a machine-plate cylinder section fixedly provided on a machine-plate drive shaft. The machine plate is fitted onto the machine-plate cylinder section from one end side thereof. The machine-plate cylinder section has, on its outer circumference, a groove for circumferential positioning into which the engagement portion of the machine plate is fitted from the one end side thereof; and a stopper for axial positioning with which an end portion of the machine plate comes into contact. In this case, the machine plate can be accurately and readily attached to the machine-plate cylinder section at a predetermined position. Further, the machine plate can be readily removed from the one end side of the machine-plate cylinder section.

Preferably, the bending angle of the engagement portion of the machine plate is greater than 90 degrees.

The "bending angle" is an angle of actually bending the engagement portion from a state of the flat sheet. Therefore, the angle between the engagement portion and an adjacent portion of the sheet (sheet-engagement-portion angle) is a value obtained by subtracting the bending angle from 180 degrees.

When the bending angle of the engagement portion is rendered greater than 90 degrees, the sheet-engagement-portion angle becomes smaller than 90 degrees.

In this case, preferably, the machine-plate cylinder section is rotated in such a direction that the end portion of the sheet, which constitutes the machine-plate body, the end portion having the engagement portion, is located on the front side with respect to the rotational direction. By virtue of such rotation, the projecting end of the engagement portion faces rearward with respect to the rotational direction. Thus, as the machine-plate cylinder section rotates, the engagement portion bites into the groove, so that the position of the machine plate is free from deviation.

Preferably, the bending angle is 125 degrees to 145 degrees inclusive (the sheet-engagement-portion angle is 55 degrees to 35 degrees inclusive). Most preferably, the bending angle is 135 degrees (the sheet-engagement-portion angle is 45 degrees).

For example, manufacture of a machine plate by use of the device of the present invention is performed as follows.

First, a rectangular sheet is manufactured such that an engagement portion is formed at one end portion of the sheet, and a forme area is formed at a predetermined portion excluding portions near the opposite ends of the sheet. The engagement portion is fitted into the groove of the cylinder section, the sheet is wound around the outer circumferential portion of the cylinder section, and the opposite end portions of the sheet are superposed on each other. Before or after the sheet is wound around the cylinder section, the magnetic attraction member is magnetized so as to bring the sheet into close contact with the outer circumferential surface of the cylinder section by means of a magnetic force, to thereby maintain the state where the opposite end portions are superposed on each other. For example, the magnetic attraction member is magnetized after the engagement portion is fitted into the groove of the cylinder section. The sheet is wound around the cylinder section in a state where the sheet is attracted to the outer circumferential surface of the cylinder section by means of the magnetic force. In a state in which the sheet is held on the cylinder section, the superposed opposite end portions of the sheet are joined together by appropriate means such as spot welding. Finally, the magnetic attraction member is demagnetized so as to cancel the magnetic attraction, and the sheet is then moved in the axial direction along the outer circumference of the cylinder section and the groove and removed from the front end side of the cylinder section. Formation of a forme in the forme area; i.e., a forme-making process, may be performed for the forme area of the sheet or the forme area of the cylindrical machine plate.

Use of the device of the present invention enables a cylindrical printer machine plate to be easily manufactured as described above.

In the device of the present invention, for example, a plate-shaped electrode for spot welding is provided in the outer circumferential portion of the cylinder section at a position corresponding to the joint portion of the sheet wound around the cylinder section with the engagement portion fitted into the groove.

In this case, joining of the sheet can be readily performed through spot welding by use of the plate-shaped electrode of the cylinder section and a separately prepared bar-shaped electrode for spot welding.

In the above-described device, for example, at a position located radially outward of the plate-shaped electrode for spot welding, there is provided a welding head which has the bar-shaped electrode for spot welding and which can move in relation to the plate-shaped electrode at least in the radial direction and axial direction of the cylinder section.

In this case, joining of the sheet can be readily performed by properly moving the bar-shaped electrode in relation to the plate-shaped electrode.

Movement of the bar-shaped electrode may be performed automatically or manually.

In the device of the present invention, for example, a diameter adjustment member is provided in the outer circumferential portion of the cylinder section such that the diameter adjustment member can move between a position where the diameter adjustment member sinks inward under the outer circumferential surface of the cylinder section and a position where the diameter adjustment member projects outward beyond the outer circumferential surface.

In this case, when the diameter adjustment member is caused to sink inward under the outer circumferential surface of the cylinder section, a manufactured machine plate has an inner diameter determined by the outer diameter of the cylinder section; and when the diameter adjustment member is caused to project outward beyond the outer circumferential surface of the cylinder section, a manufactured machine plate has an inner diameter determined by the outer diameter of the cylinder section and the projection amount of the diameter adjustment member. Therefore, the inner diameter of the manufactured machine plate can be adjusted by changing the position of the diameter adjustment member.

In the device of the present invention, for example, an air chamber is formed within the cylinder section; air discharge holes communicating with the air chamber are formed in the outer circumferential portion of the cylinder section at a plurality of locations in the axial direction and the circumferential direction; and air supply means is provided so as to supply air to the air chamber.

In this case, the air supply means supplies compressed air to the air chamber of the cylinder section after a cylindrical machine plate is formed by joining the opposite end portions of the sheet held on the cylinder section and the magnetic attraction member is demagnetized. The air supplied to the air chamber flows outward from the air discharge holes, and the machine plate formed in a cylindrical shape expands in the radial direction due to the pressure of the air, whereby the inner diameter of the machine plate becomes larger than the outer diameter of the cylinder section, and the machine plate can be readily removed from the cylinder section.

Effect of the Invention

According to the printer-machine-plate manufacturing device of the present invention, as mentioned above, a cylindrical printer machine plate can be readily manufactured.

DESCRIPTION OF REFERENCE NUMERALS

Figure 1:
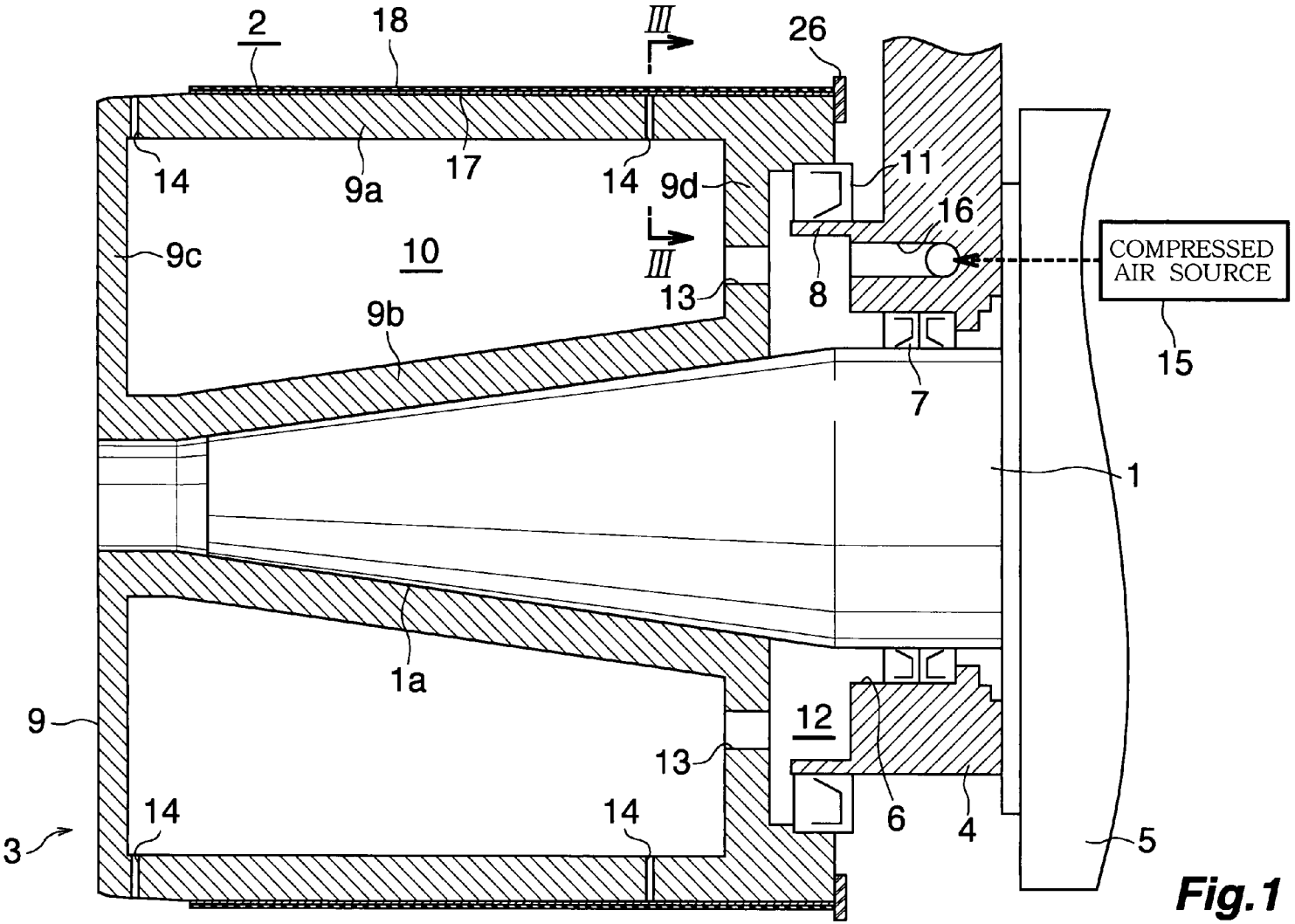
FIG. 1 is a vertical sectional view of a machine-plate mounting device of a printer on which a machine plate is mounted.

2: machine plate for printer
17: machine-plate body
18: forme area
19: sheet
20: joint portion
21: engagement portion

30: machine-plate manufacturing device
32: cylinder section
33: welding head
33*a*: bar-shaped electrode
39: plate-shaped electrode
40: groove
45: diameter adjustment member
51: magnetic attraction member
53: permanent magnet
54: permanent-magnet support shaft
56: knob
57: air chamber
58: air hole
59: communication hole
60: air discharge hole
61: compressed air source

MODES FOR CARRYING OUT THE INVENTION

An embodiment of the present invention will next be described with reference to the drawings.

First, an example printer and an example cylindrical machine plate used therefor will be described with reference to FIGS. 1 to 5.

Figure 2:
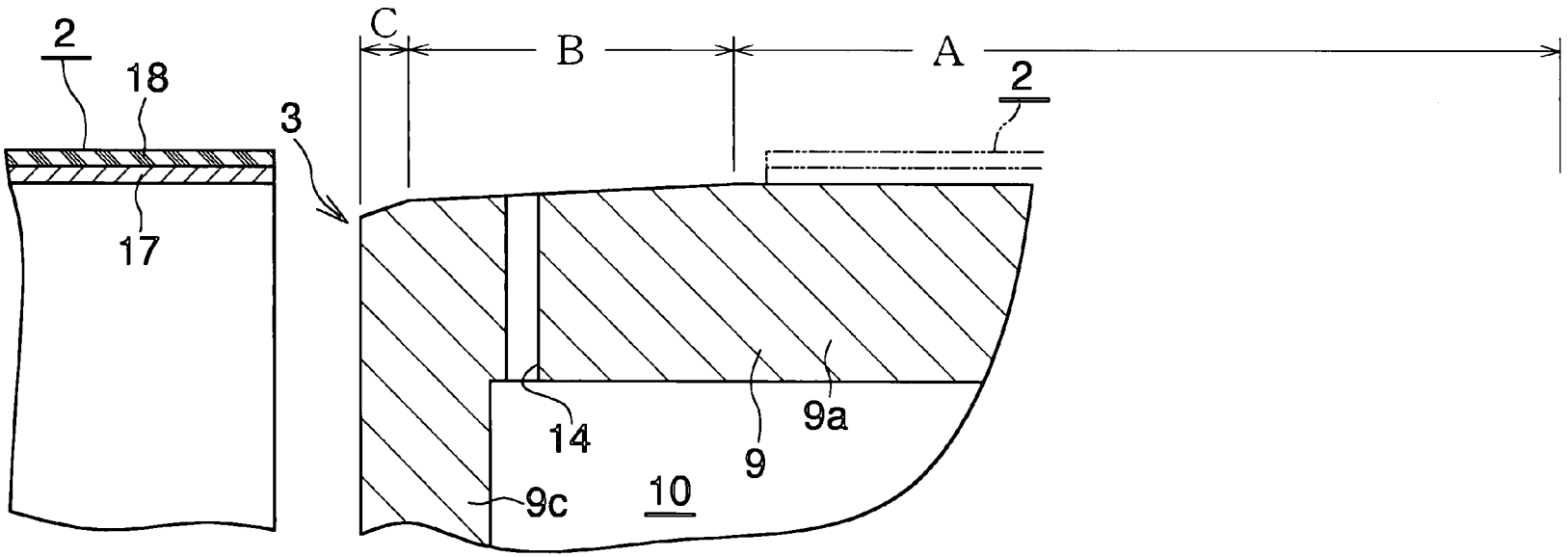
FIG. 2 is a vertical sectional view showing, on an enlarged scale, a portion of the machine-plate mounting device and a portion of a machine plate before being attached thereto.
Figure 3:
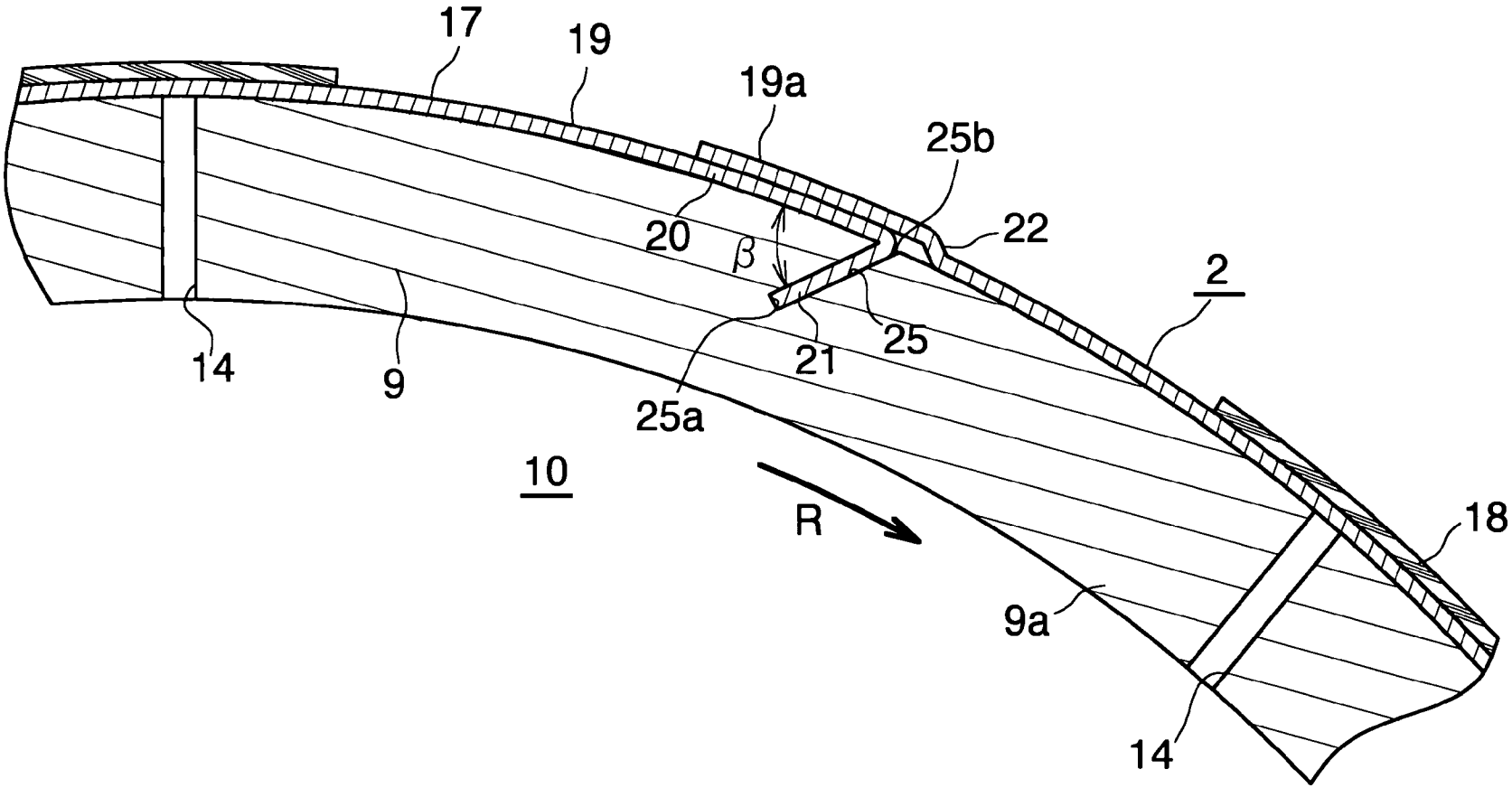
FIG. 3 is an enlarged sectional view taken along line III-III of FIG. 1.
Figure 4:
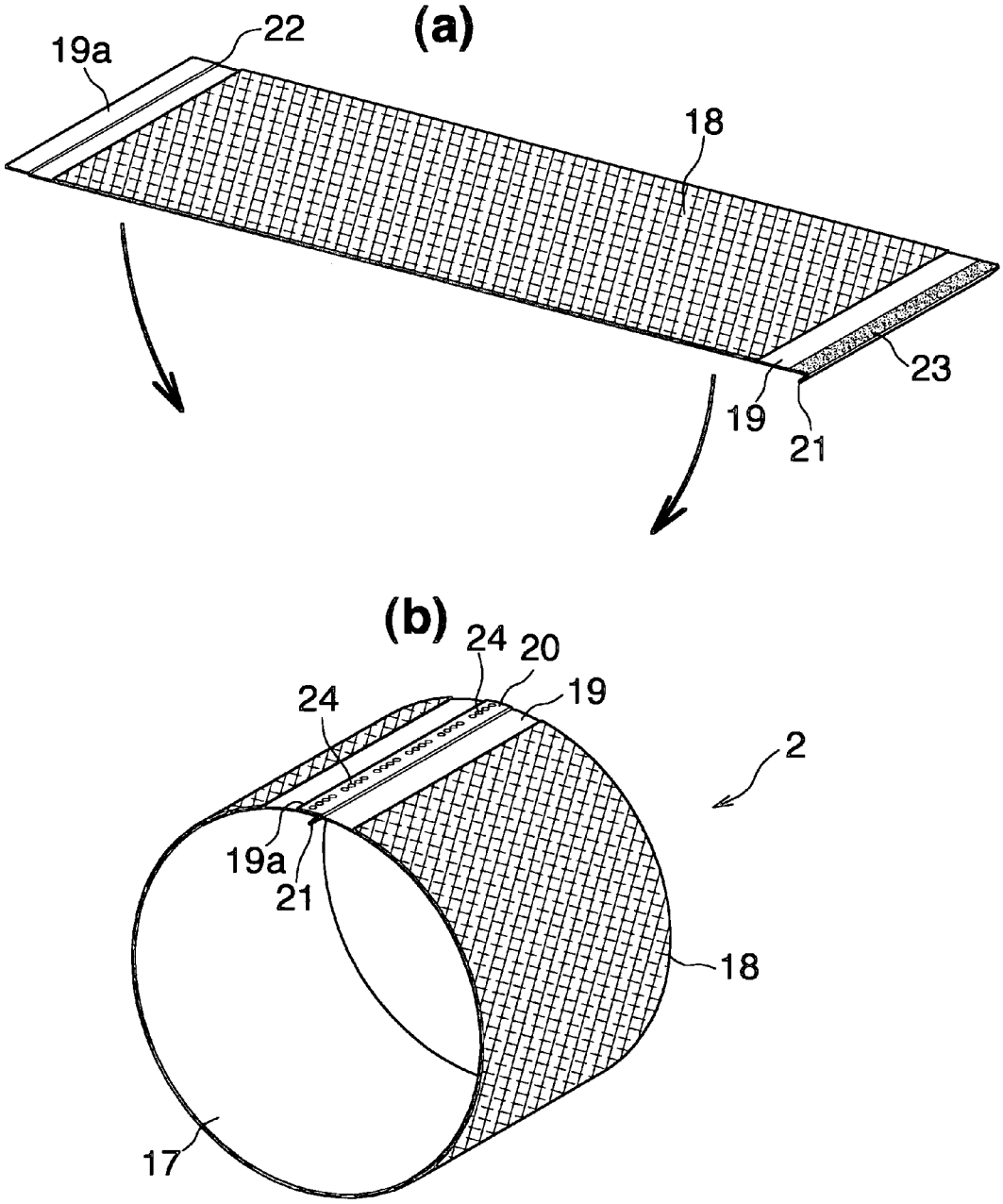
FIG. 4 is a pair of perspective views showing a machine plate and a process of manufacturing the machine plate.
Figure 5:
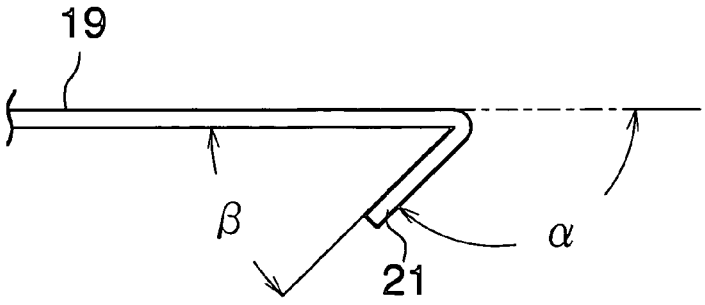
FIG. 5 is a side view showing, on an enlarged scale, a portion of a sheet as viewed before formation of the machine plate of FIG. 4.

FIG. 1 is a vertical sectional view of a machine-plate mounting device 3 which is attached to a machine-plate drive shaft 1 of the printer and on which a machine plate 2 is mounted. FIG. 2 is a vertical sectional view showing, on an enlarged scale, a portion of the machine-plate mounting device 3 and a portion of the machine plate 2 before being attached thereto. FIG. 3 is an enlarged sectional view (transverse sectional view) taken along line III-III of FIG. 1. FIG. 4 is a pair of perspective views showing the machine plate 2 and a process of manufacturing the machine plate 2. FIG. 5 is a side view showing, on an enlarged scale, a portion of a sheet as viewed before formation of the machine plate of FIG. 4. In the following description, the upper and lower sides of FIG. 1 will be referred to as "upper" and "lower," respectively. The left-hand and right-hand sides of FIG. 1 will be referred to as "front" and "rear," respectively. The left-hand and right-hand sides as viewed from the front toward the rear will be referred to as "left" and "right," respectively.

In FIG. 1, reference numeral 4 denotes a thick-plate-like machine frame of a printer which extends in the vertical direction and in the left-right direction; and 5 denotes a bearing housing provided on the rear side of the machine frame 4. A front portion of the machine-plate drive shaft 1 is rotatably supported by the bearing housing 5, and a rear portion of the machine-plate drive shaft 1 is rotatably supported by an unillustrated bearing housing. The shaft 1 is rotated in a predetermined direction (in this example, clockwise as viewed from the front side) at a predetermined speed by known drive means. A portion of the shaft 1 near the front end thereof passes through a circular hole 6 formed in the machine frame 4 and projects frontward from the machine frame 4. An oil seal 7 is provided along the inner circumferential wall of the hole 6 so as to establish sealing against the shaft 1. A taper portion 1*a* is formed on a front end portion of the shaft 1 located on the front side of the machine frame 4 such that the diameter of the taper portion decreases toward the distal end thereof. A short cylindrical portion 8 is formed on the front surface of the machine frame concentrically with the hole 6 such that the cylindrical portion 8 projects forward from the front surface and is located radially outward of the hole 6.

The machine-plate mounting device 3 is removably fixed on the shaft taper portion 1*a*.

The machine-plate mounting device 3 includes a machine-plate cylinder section 9 to be fixed on the shaft taper portion 1*a*. The machine-plate cylinder section 9 is composed of an outer cylindrical portion 9*a* concentric with the shaft 1; an inner tapered tubular portion 9*b* which is concentric with the outer cylindrical portion 9*a* and whose diameter decreases toward the front end thereof; a front end wall 9*c* which connects together front end portions of the cylindrical portion 9*a* and the tapered tubular portion 9*b*; and a rear end wall 9*d* which connects together rear end portions of the cylindrical portion 9*a* and the tapered tubular portion 9*b*. An annular space surrounded by these portions and walls serves an air chamber 10. The machine-plate cylinder section 9 is fitted onto the shaft taper portion 1*a* such that the inner circumferential surface of the tapered tubular portion 9*b* comes into close contact with the outer circumferential surface of the shaft taper portion 1*a*, and is fixed thereto by use of an unillustrated suitable means. The machine-plate cylinder section 9 is formed of a proper magnetic or nonmagnetic metal. In this example, SS steel, which is a general structural steel, is used to form the machine-plate cylinder section 9. Further, the cylindrical portion 9*a*, the tapered tubular portion 9*b*, the front end wall 9*c*, and the rear end wall 9*d* are formed to have a relatively large wall thickness from the viewpoint of strength.

A rear portion of the cylindrical portion 9*a* extends rearward beyond the rear end wall 9*d* to a point located radially outward of the short cylindrical portion 8 of the machine frame 4. An oil seal 11 is provided along the inner circumferential surface of a rear end portion of the cylindrical portion 9*a* so as to establish sealing against the short cylindrical portion 8, whereby an annular closed space 12 is formed between the rear end wall 9*d* and the machine frame 4. A plurality of communication holes 13 are formed in the rear end wall 9*d* so as to establish communication between the air chamber 10 and the closed space 12.

A plurality of air discharge holes 14 are formed in the cylindrical portion 9*a* at equal intervals in the circumferential direction, at a plurality of locations with respect to the front-rear direction, the locations facing the air chamber 10 (in this example, two locations; i.e., a location at the front end and a location near the rear end).

An air passage 16 is formed in the machine frame 4 of the printer. The air passage 16 is connected to a compressed air source 15, and communicates with the closed space 12. The compressed air source 15, the air passage 16, the closed space 12, and the communication hole 13 constitute air supply means.

As shown in detail in FIG. 2, a portion A of the cylindrical portion 9*a* extending rearward from a position located slightly rearward of the front-side discharge hole 14 has a fixed outer diameter. The outer diameter of a portion B of the cylindrical portion 9*a* between the front end of the portion A and a position located frontward of the discharge hole 14 decreases toward the front end of the portion B. The outer diameter of a portion C of the cylindrical portion 9*a* located on the front side of the portion B decreases further toward the front end of the portion C. In this example, the outer diameter of the portion A of the cylindrical portion 9*a* is 220 mm, and the difference in outer diameter between the portion A and the front end of the portion B is about 0.2 mm.

The machine plate 2 assumes a cylindrical shape. The machine plate 2 is composed of a cylindrical machine-plate body 17 and a forme area 18.

The cylindrical machine-plate body 17 is formed from a rectangular sheet 19 of an elastic material as shown in FIG. 4(*a*). The sheet 19 is formed into a cylindrical shape with its opposite end portions superposed on each other and joined together, thereby forming the cylindrical machine-plate body 17. No limitation is imposed on the thickness of the sheet 19, so long as the sheet can be formed into a cylindrical shape and can maintain the cylindrical shape by means of its elastic force. In this example, the thickness is about 0.24 mm. The inner diameter of the machine-plate body 17 is slightly smaller than the outer diameter of the portion A of the cylindrical portion 9*a* of the machine-plate cylinder section 9, and approximately equal to the outer diameter of a portion of the portion B located immediately rearward of the discharge hole 14. The machine-plate body 17 is formed from an appropriate magnetic or nonmagnetic metal. In this example, SS steel, which is a general structural steel, is used to form the machine-plate body 17. A joining means for the sheet 19 is arbitrary. In this example, an adhesive and spot welding are used as the joining means.

The forme area 18 is provided at a predetermined portion of the outer circumferential surface of the machine-plate body 17 excluding the joint portion 20.

An end portion of the sheet 19 located on the inner side of the joint portion 20 is bent inward, thereby forming the engagement portion 21. In FIG. 5, an angle $\alpha$ at which the engagement portion 21 is actually bent from a flat state of the sheet 19 represented by the chain line is called the bending angle, and an angle $\beta$ between the engagement portion 21 and an adjacent portion of the sheet 19 is called the sheet-engagement-portion angle. The bending angle $\alpha$ is preferably greater than 90 degrees (the sheet-engagement-portion angle $\beta$ is less than 90 degrees), more preferably 125 degrees to 145 degrees inclusive (the sheet-engagement-portion angle $\beta$ is 55 degrees to 35 degrees inclusive), most preferably 135 degrees (the sheet-engagement-portion angle $\beta$ is 45 degrees). In this example, the bending angle $\alpha$ is about 135 degrees, and the sheet-engagement-portion angle $\beta$ is about 45 degrees. As shown in detail in FIG. 3, a step portion 22 is formed between an end portion 19*a* of the sheet 19 located on the outer side of the joint portion 20 of the machine plate 2 and a center-side portion of the sheet 19, and the inner diameter of the end portion 19*a* is greater than that of the remaining portion of the sheet 19. The size of the step of the step portion 22 is equal to or less than the thickness of the sheet 19.

A method of manufacturing the machine plate 2 is arbitrary. Next, an example method of manufacturing the machine plate 2 will be described with reference to FIG. 4.

First, as shown in FIG. 4(*a*), the engagement portion 21 is formed at an end portion of the rectangular sheet 19; the step portion 22 is formed at the other end thereof; and the forme area 18 is formed at a predetermined portion of the sheet 19 excluding opposite end portions. Then, an appropriate adhesive 23 is applied to the surface of an end portion of the sheet 19 associated with the engagement portion 21, the surface being located on a side opposite the engagement portion 21. Next, as shown in FIG. 4(*b*), the sheet 19 is formed into a cylindrical shape; an opposite end portion 19*a* of the sheet 19 is externally overlaid on the adhesive 23 for joining; and joining of the joint portion 20 is enhanced by spot welding. In FIG. 4(*b*), reference numeral 24 denotes spot-welded zones. Forming a forme in the forme area 28; i.e., a forme-making process, may be performed on the forme area 18 of the sheet 19 of FIG. 4(*a*) or on the forme area 18 of the cylindrical machine plate 2 of FIG. 4(*b*).

As shown in FIG. 3, a groove 25 for circumferential positioning into which the engagement portion 21 of the machine plate 2 is fitted is formed in the outer circumference of the cylindrical portion 9*a* of the machine-plate cylinder section 9 over the entire length thereof. The angle $\beta$ between the groove 25 and the outer circumferential surface of the cylindrical portion 9*a* is equal to the sheet-engagement-portion angle $\beta$ of the engagement portion 21 of the machine plate 2. The groove 25 is formed such that its bottom portion 25*a* is located rearward of its opening portion 25*b* with respect to the rotational direction of the machine-plate cylinder section 9 (the direction indicated by an arrow R in FIG. 3).

As shown in FIG. 1, an annular stopper 26 for axial positioning is fixed to an outer circumferential portion of the rear end surface of the cylindrical portion 9*a* of the machine-plate cylinder section 9 in such a manner as to slightly project radially outward beyond the outer, circumferential surface of the cylindrical portion 9*a*.

When the machine plate 2 is to be mounted on the machine-plate cylinder section 9, compressed air is supplied to the air chamber 10 of the machine-plate cylinder section 9. When compressed air is supplied to the air chamber 10, the air flows outward from the air discharge holes 14 on the outer circumferential surface of the cylindrical portion 9*a*. When the cylindrical machine plate 2 is fitted onto the outer circumferential surface of the machine-plate cylinder section 9 while the engagement 21 is fitted into the groove 25 in this state, the machine plate 2 expands in the radial direction due to the pressure of the air discharged from the air discharge holes 14, whereby the inner diameter of the machine plate 2 becomes larger than the outer diameter of the machine-plate cylinder section 9, and the machine plate 2 can be readily fitted onto the outer circumference of the machine-plate cylinder section 9. When the machine plate 2 comes into engagement with the stopper 26 and stops, the supply of compressed air to the air chamber 10 is stopped. As a result, the machine plate 2 contracts and comes into close contact with the outer circumferential surface of the cylindrical portion 9*a*, whereby the machine plate 2 is fixed in a press-fitted state at a position where the machine plate 2 comes into engagement with the stopper 26. At that time, in relation to the machine-plate cylinder section 9, the machine plate 2 is accurately positioned in the circumferential direction by the groove 25 and in the axial direction by the stopper 26.

At the time of printing, the machine-plate cylinder section 9 is rotated in a state where the machine plate 2 is fixed to the machine-plate cylinder section 9 as described above. At that time, the distal end of the engagement portion 21 of the machine plate 2 faces rearward with respect to the rotational direction R, whereby the engagement portion 21 bites into the groove 25, and the position of the machine plate 2 is free from deviation.

When the machine plate 2 mounted on the machine-plate cylinder section 9 as described above is to be removed from the machine-plate cylinder section 9, compressed air is supplied to the air chamber 10 of the machine-plate cylinder section 9. When air is supplied to the air chamber 10 and is caused to flow out of the discharge holes 14, the machine plate 2 expands in the radial direction due to the pressure of the air, whereby the inner diameter of the machine plate 2 becomes larger than the outer diameter of the machine-plate cylinder section 9, and the machine plate 2 can be readily removed from the machine-plate cylinder section 9.

Next, an example machine-plate manufacturing device will be described with reference to FIGS. 6 to 12.

Figure 6:
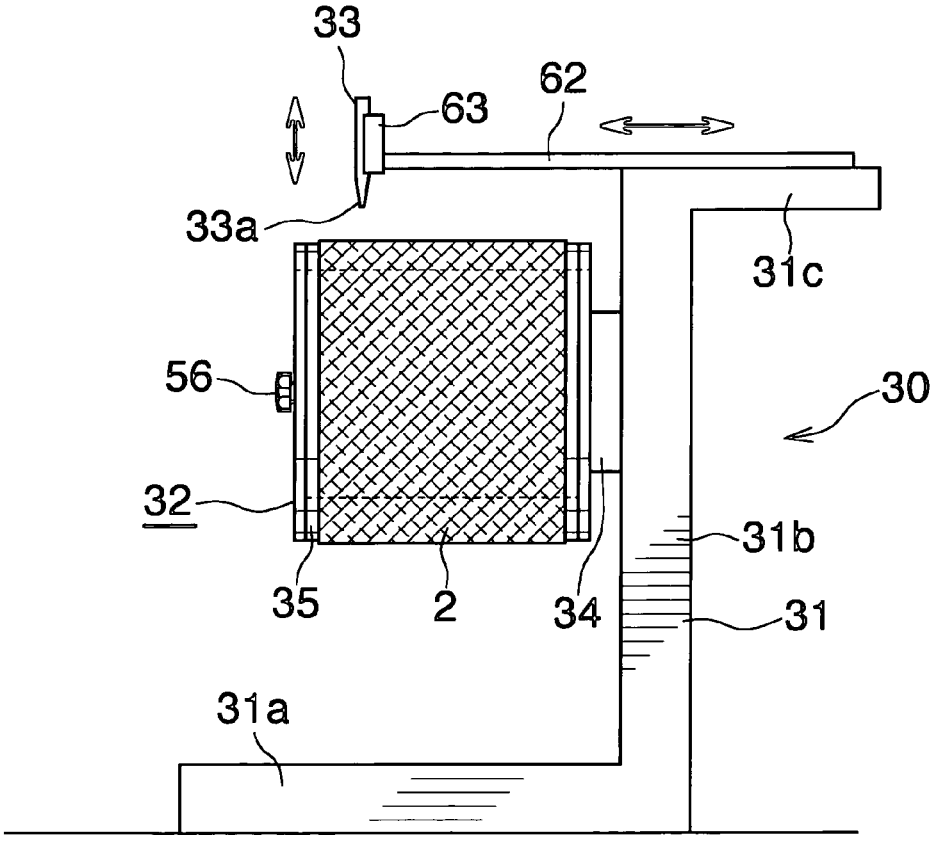
FIG. 6 is a side view of a machine-plate manufacturing device showing an embodiment of the present invention.
Figure 7:
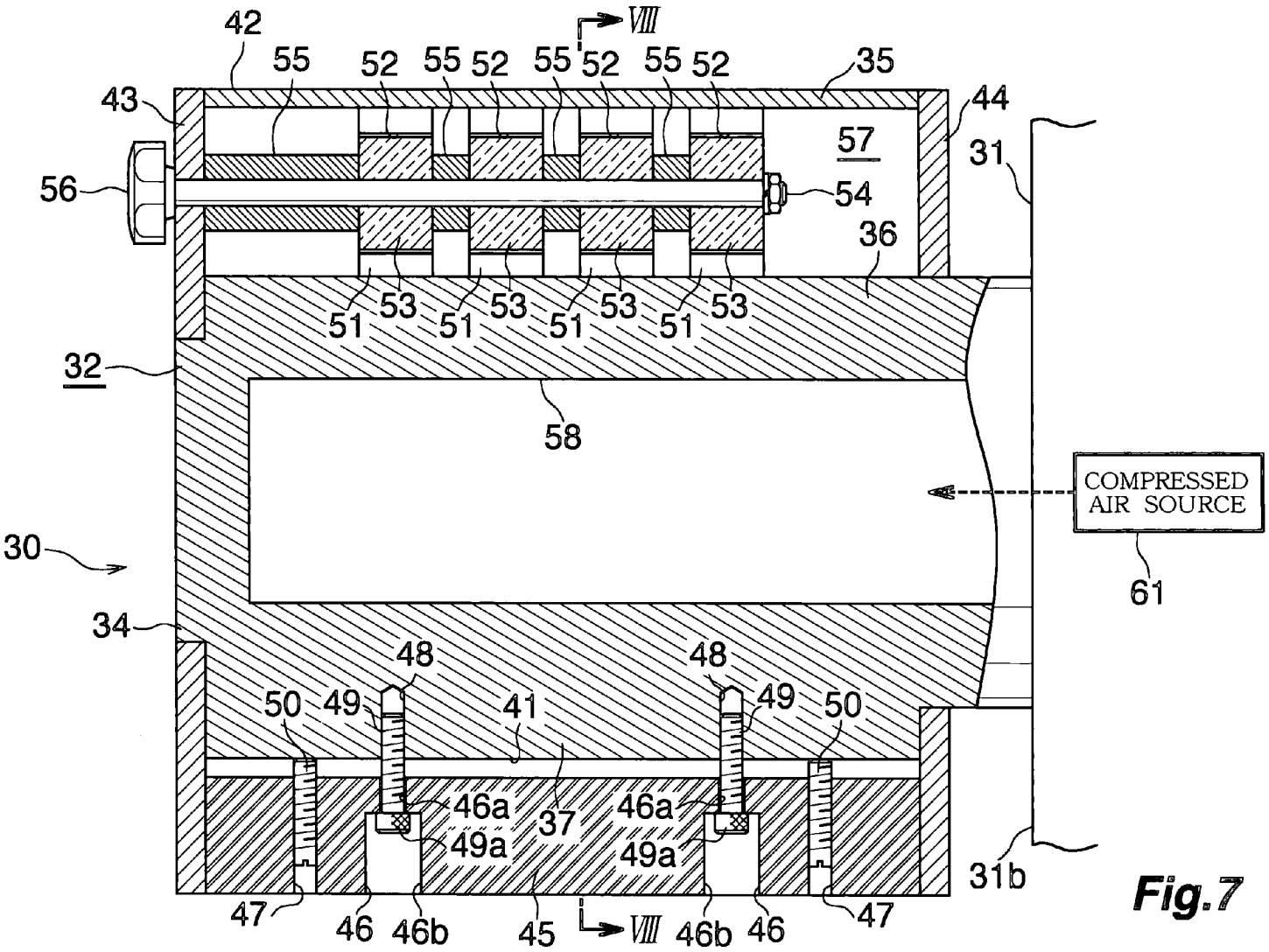
FIG. 7 is a vertical sectional view (sectional view taken along line VII-VII of FIG. 8) showing, on an enlarged scale, a main portion of the machine-plate manufacturing device.
Figure 8:
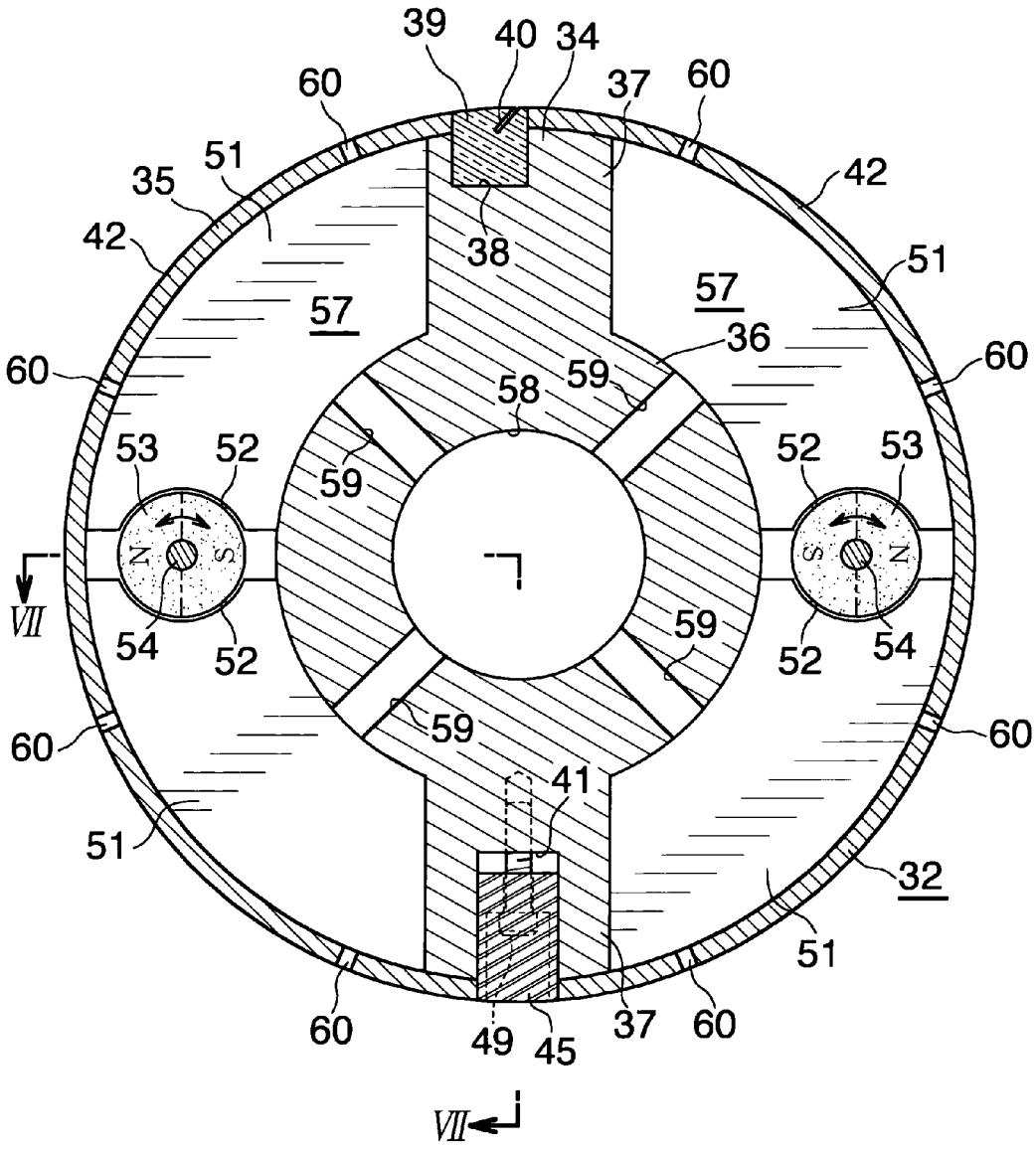
FIG. 8 is a transverse sectional view taken along line VIII-VIII of FIG. 7.
Figure 9:
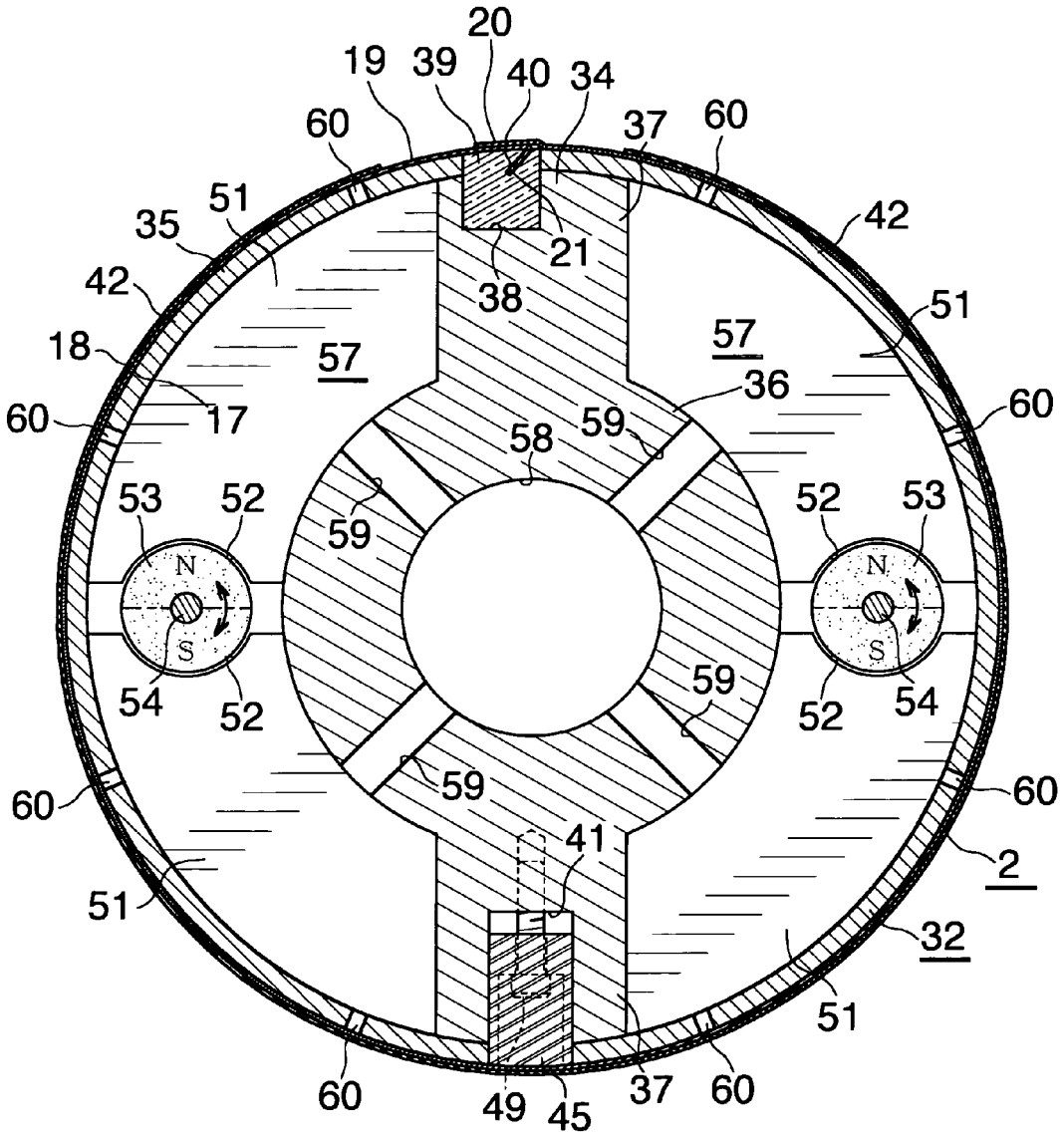
FIG. 9 is a transverse sectional view corresponding to FIG. 8 and showing a state different from the state shown in FIG. 8.
Figure 10:
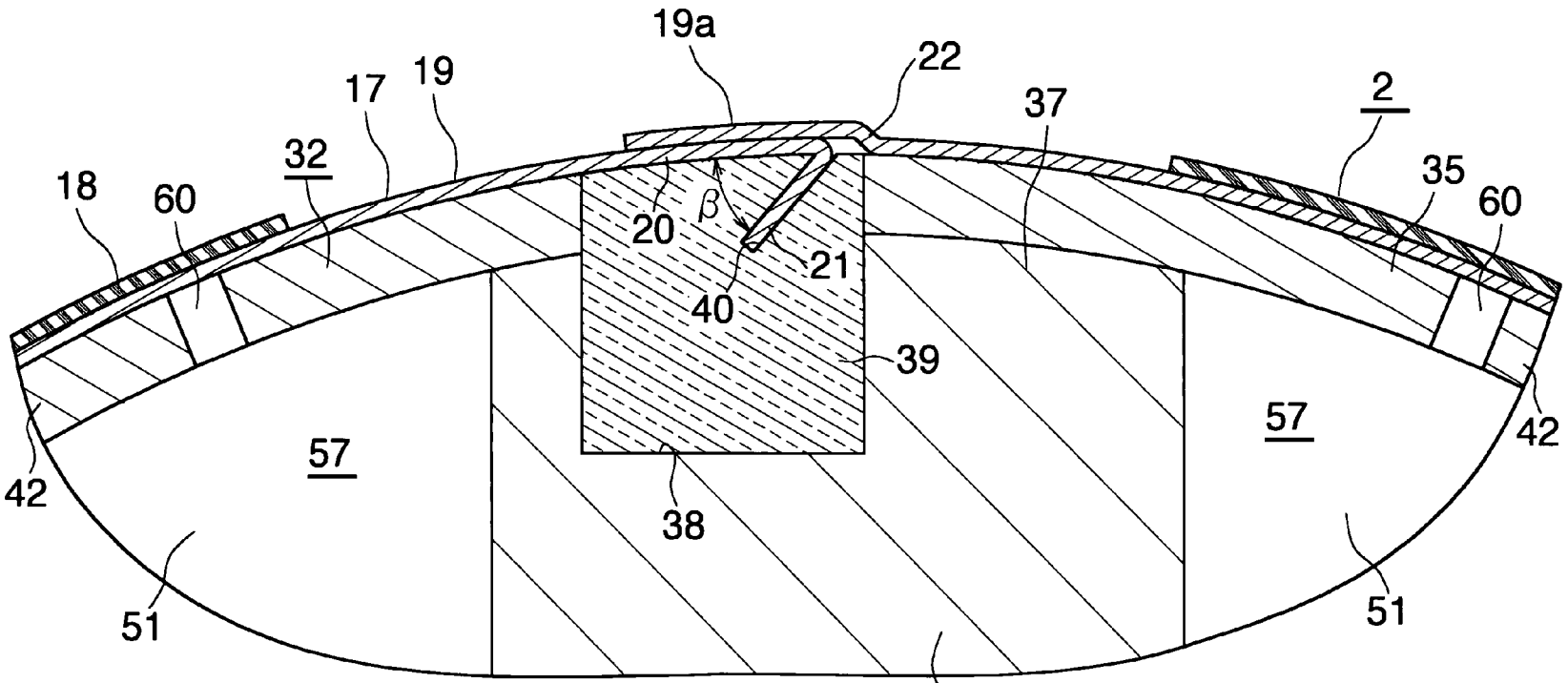
FIG. 10 is a transverse sectional view showing, on an enlarged scale, a portion of FIG. 9.
Figure 11:
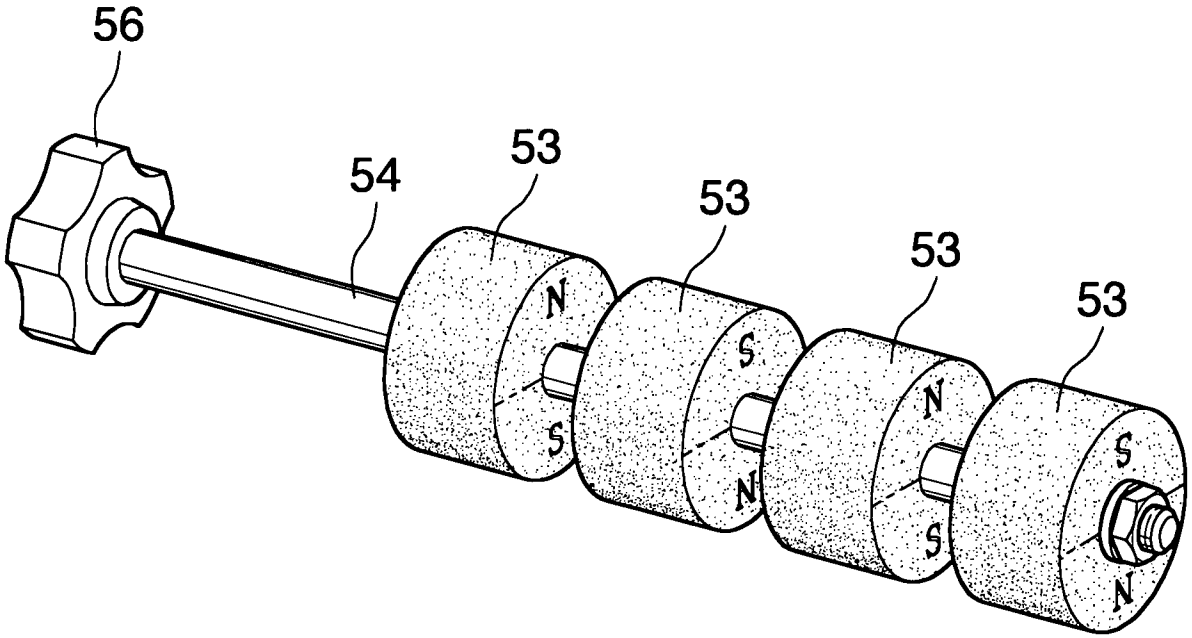
FIG. 11 is a perspective view of a portion extracted from the machine-plate manufacturing device.
Figure 12:
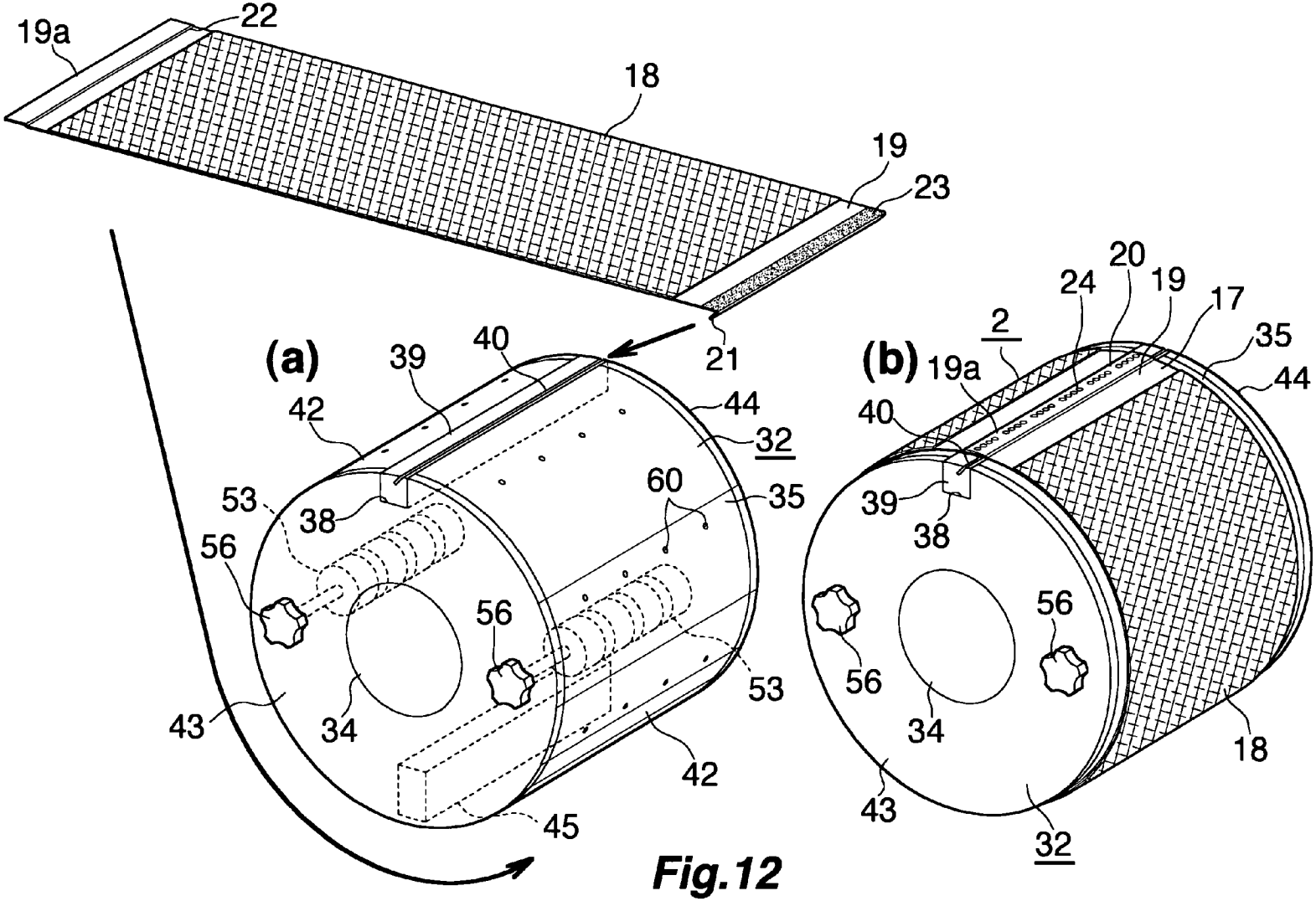
FIG. 12 is a pair of perspective views showing a process of manufacturing a machine plate by use of the machine-plate manufacturing device.

FIG. 6 is a side view showing the overall structure of a machine-plate manufacturing device 30. FIG. 7 is a vertical sectional view (sectional view taken along line VII-VII of FIG. 8) showing, on an enlarged scale, a main portion of the machine-plate manufacturing device 30. FIG. 8 is a transverse sectional view taken along line VIII-VIII of FIG. 7. FIG. 9 is a transverse sectional view corresponding to FIG. 8 and showing a state different from the state shown in FIG. 8. FIG. 10 is a transverse sectional view showing, on an enlarged scale, a portion of FIG. 9. FIG. 11 is a perspective view of a portion extracted from the machine-plate manufacturing device. FIG. 12 is a pair of perspective views showing a process of manufacturing a machine plate by use of the machine-plate manufacturing device. In the following description, the upper and lower sides of FIGS. 6 and 7 will be referred to as "upper" and "lower," respectively. The left-hand and right-hand sides of FIGS. 6 and 7 will be referred to as "front" and "rear," respectively. The left-hand and right-hand sides as viewed from the front toward the rear will be referred to as "left" and "right," respectively.

As shown in FIG. 6, the machine-plate manufacturing device 30 includes a generally L-shaped stand 31, a cylinder section 32, and a welding head 33.

The stand 31 includes a horizontal base portion 31*a*, a vertical portion 31*b* extending upward from a rear end portion of the base portion 31*a*, and an upper horizontal portion 31*c* extending horizontally and rearward from an upper end portion of the vertical portion 31*b*.

The cylinder section 32 includes an inside member 34 fixed to the vertical portion 31*b* of the stand 31, and a cylindrical sheet mounting portion 35 disposed radially outward of the inside member 34. The inside member 34 includes a cylindrical columnar portion 36 whose rear end portion is fixed to the vertical portion 31*b* and which extends forward and horizontally, and two projection portions 37 formed integrally with the cylindrical columnar portion 36 at symmetrical upper and lower positions such that the projection portions 37 project radially outward. The outer circumferential surfaces of the two projection portions 37 partially form a single cylindrical surface concentric with the cylindrical columnar portion 36. The inside member 34 is formed of a proper nonmagnetic material (in this example, an aluminum alloy).

A rectangular groove 38 extending in the front-rear direction is formed on the outer circumferential surface of the upper projection portions 37 over the entire length. A plate-shaped electrode 39 for spot welding, which assumes the form of a square rod and extends in the front-rear direction, is fitted into the groove 38. The electrode 39 formed of a proper material which can be used for plate-shaped electrodes for spot welding. In this example, the electrode 39 is formed of a copper alloy. An upper portion of the electrode 39 projects outward in the radial direction from the outer circumferential surface of the projection portion 37. The outer circumferential surface of the upper portion partially forms a cylindrical surface concentric with the cylindrical columnar portion 36. A groove 40 is formed on the outer circumferential surface of the electrode 39 over the entire length thereof. The engagement portion 21 of the sheet 19 can be removably inserted into the groove 40 from the distal end (front end) thereof. The angle β between the groove 40 and the outer circumferential surface of the electrode 39 is equal to the sheet-engagement-portion angle β of the engagement portion 21 of the sheet 19. A relatively deep, diameter-adjustment-member accommodation rectangular groove 41 is formed on, the outer circumferential surface of the lower projection portion 37 over the entire length thereof.

The sheet mounting portion 35 is composed of left and right semicylindrical halves 42 having a relatively large thickness. Each half 42 is formed of a proper magnetic material (in this case, SS steel, which is a general structural steel). An upper edge portion of the left-hand half 42 is brought into contact with and fixed to a left-side end surface of a portion of the electrode 39 projecting from the upper projection portion 37 and an outer circumferential surface of the upper projection portion 37 located on the left side of the left-side end surface, and a lower edge portion of the left-hand half 42 is brought into contact with and fixed to an outer circumferential surface of the lower projection portion 37 located on the left side of the rectangular groove 41. An upper edge portion of the right-hand half 42 is brought into contact with and fixed to a right-side end surface of a portion of the electrode 39 projecting from the upper projection portion 37 and an outer circumferential surface of the upper projection portion 37 located on the right side of the right-side end surface, and a lower edge portion of the left-hand half 42 is brought into contact with and fixed to an outer circumferential surface of the lower projection portion 37 located on the right side of the rectangular groove 41. Inner circumferential portions of annular end wall members 43 and 44 are respectively fixed to a front end portion of the inside member 34 and a portion of the inside member 34 near the rear end thereof. Front and rear end surfaces of the halves 42 are fixed to outer circumferential portions of mutually facing end surfaces of the front and rear end wall members 43 and 44. Although not illustrated in detail, the rectangular grove 38 and the electrode 39 reach the front end of the front end wall member 43, and the outer circumferential surfaces of the electrode 39, the halves 42, and the front and rear end wall members 43 and 44 form a single cylindrical surface concentric with the cylindrical columnar portion 36.

The front and rear ends of the rectangular groove 41 of the lower projection portion 37 are closed by the end wall members 43 and 44, respectively. A diameter adjustment member 45, which assumes the form of a rectangular column and extends in the front-rear direction, is fitted in the rectangular groove 41 such that the diameter adjustment member 45 can move in the radial direction. A lower surface of the diameter adjustment member 45 partially forms a cylindrical surface having a diameter equal to that of the sheet mounting portion 35. The diameter adjustment member 45 has front and rear guide holes 46 and front and rear internal threads 47, which penetrate the diameter adjustment member 45 in the vertical direction. Each guide hole 46 is composed of an upper small diameter portion 46*a* for guiding, and a lower large diameter portion 46*b* for bolt head accommodation. Internal threads 48 are formed in a bottom portion of the rectangular groove 41 at positions corresponding to the guide holes 46. Guide bolts 49 are inserted into the guide holes 46 from below, and screwed into the internal threads 48 formed in the bottom portion of the rectangular groove 41. The thread-side (upper side) annular end surface of the head portion 49*a* of each guide bolt 49 comes into contact with downward facing annular end surface between the small diameter portion 46*a* and the large diameter portion 46*b* of the corresponding guide hole 46, and the bolt head 49*a* is located within the large diameter portion 46*b*. Adjustment screws 50, each having a thread formed over the entire length thereof, are screwed into the corresponding internal threads 47 of the diameter adjustment member 45, and the distal ends (upper ends) of the adjustment screws 50 are brought into pressure-contact with the bottom portion of the rectangular groove 41. The lower ends of the adjustment screws 50 are located inward (upward) of the lower surface of the diameter adjustment member 45. The diameter adjustment member 45 can move along the guide bolts 49 between a position where the diameter adjustment member 45 sinks inward under the outer circumferential surface of the mounting portion 35 and a position where the diameter adjustment member 45 projects outward beyond the outer circumferential surface of the mounting portion 35. The diameter adjustment member 45 is fixed to a position between the two positions by means of adjusting the vertical positions of the guide bolts 49 and the adjustment screws 50.

Upper and lower magnetic attraction members 51 formed of a magnetic material are disposed, at each of a plurality of (in this example, four) positions with respect to the front-rear direction, within a space between a left portion of the inside member 34 and the left-hand half 42 which partially constitutes the sheet mounting portion 35, the space having an arcuate transverse cross section. In this example, the attraction members 51 are formed of SS steel, which is a general structural steel, and have a fan-shaped transverse cross section. Inner portions of the attraction members 51 extend along and are fixed to the outer circumferences of the left portion of the inside member 34, and outer portions of the attraction members 51 extend along and are fixed to the inner circumference of the corresponding half 42. The attraction members 51 are disposed at equal intervals in the front-rear direction. Two attraction members 51 are arranged in the vertical direction (in the circumferential direction) with a relatively small clearance formed therebetween. Permanent magnet grooves 52 are formed on mutually facing side surfaces of the upper and lower attraction members 51 such that the permanent magnet grooves 52 extend over the entire width with respect to the front rear direction and their transverse cross sections form a portion of a single circle.

Permanent magnets 53, each assuming the form of a short cylindrical column, are rotatably supported between the grooves 52 of the upper and lower attraction members 51. In each permanent magnet 53, two magnetic poles are formed in two semicircular portions located on opposite sides of single plane passing through the axis such that one semicircular portion becomes an N-pole and the other semicircular portion becomes an S-pole. The permanent magnets 53 are concentrically fixed to a single permanent-magnet support shaft 54 extending in the front-rear direction, with spacers 55 interposed between the permanent magnets 53. A front portion of the support shaft 54 is rotatably supported by the front end wall member 43, and a knob 56 for position switching is fixed to a front end portion of the support shaft 54 projecting frontward from the front end wall member 43. The support shaft 54 and the knob 56 constitute permanent magnet switching means. In this example, as shown in FIG. 11, the plurality of permanent magnets 53 are disposed such that the orientations of the magnetic poles are reversed alternately.

Similarly, magnetic attraction members 51 formed of a magnetic material, permanent magnets 53, etc. are also provided within a space having an arcuate transverse cross section and formed between a right portion of the inside member 34 and the right-hand half 42 which partially constitutes the sheet mounting portion 35, symmetrically with these on the left-hand side respect to the left-right direction.

Through manual operation of the knob 56, the permanent magnets 53 are switched between a demagnetization position shown in FIG. 8 and a magnetization position shown in FIG. 9.

When the permanent magnets 53 are in the demagnetization position, as shown in FIG. 8, the magnetic poles of each permanent magnet 53 are arranged in the radial direction of the cylinder section 32, and the direction of the magnetic poles is parallel to the direction of boundary surfaces of two attraction members 51 adjacent to each other in the circumferential direction (the direction of a plane passing through the axis of the cylinder section 32). Therefore, each attraction member 51 is not magnetized and is in a demagnetized state.

When the permanent magnets 53 are in the magnetization position, as shown in FIG. 9, the magnetic poles of each permanent magnet 53 are arranged in the circumferential direction of the cylinder section 32, and the direction of the magnetic poles is perpendicular to the direction of the boundary surfaces of the two adjacent attraction members 51. Therefore, each attraction member 51 is magnetized and is in a magnetized state.

The left and right spaces within the cylinder section 32, in which the attraction members 51, etc. are disposed and which have an arcuate transverse cross section, serve as air chambers 57. An air hole 58 whose front end is closed is formed at the center of the cylindrical columnar portion 36 of the inside member 34. A plurality of communication holes 59 are formed between the air hole 58 and the left and right air chambers 57. The communication holes 59 are formed at a plurality positions in the circumferential direction at each of a plurality of locations with respect to the front-rear direction. A plurality of air discharge holes 60 are formed in the sheet mounting portion 35 at equal intervals in the circumferential direction at each of a plurality of locations with respect to the front-rear direction. The air hole 58 of the inside member 34 is connected to a compressed air source 61. The compressed air source 61, the air hole 58, and the communication holes 59 constitute air supply means.

A first moving body 62 movable in the front-rear direction is provided on the horizontal portion 31*c* of the stand 31, and a second moving body 63 movable in the vertical direction is provided on a front end portion of the first moving body 62. A welding head 33 is fixed to the second moving body 63 and is automatically moved in the front-rear direction and the vertical direction in response to a manual operation. A bar-shaped electrode 33*a* for spot welding is provided on the lower end of the welding head 33.

Next, an example method of manufacturing the machine plate 2 by use of the above-described machine-plate manufacturing device 30 will be described with reference to FIG. 12.

First, a sheet 19 similar to that described with reference to FIG. 4(*a*) is fabricated, and an appropriate adhesive 23 is applied to the surface of an end portion of the sheet 19 associated with the engagement portion 21, the surface being located on a side opposite the engagement portion 21. Subsequently, in a state where air is not supplied to the air chambers 57, as shown in FIG. 12(*a*), the engagement portion 21 of the sheet 19 is fitted into the groove 40 of the cylinder section 32 of the machine-plate manufacturing device 30, the sheet 19 is wound around the outer circumference of the cylinder section 32, and the opposite end portions thereof are superposed on each other and joined together by the adhesive 23. At that time, the engagement portion 21 can be fitted into the groove 40 from the outer circumferential side of the cylinder section 32. Before or after the sheet 19 is wound around the cylinder section 32, the magnetic attraction members 51 are magnetized so as to bring the sheet 19 into close contact with the outer circumferential surface of the cylinder section 32 by means of a magnetic force, to thereby maintain the state where the opposite end portions are joined together. For example, the magnetic attraction members 51 are magnetized after the engagement portion 21 is fitted into the groove 40 of the cylinder section 32. The sheet 19 is wound around the cylinder section 32 in a state where the sheet 19 is attracted to the outer circumferential surface of the cylinder section 32 by means of the magnetic force. In a state in which the sheet 19 is held on the cylinder section 32, the welding head 33 is moved so as to strongly join the opposite end portions of the sheet 19 by means of spot welding. FIG. 12(*b*) shows a state after the spot welding is completed. Finally, the magnetic attraction members 51 are demagnetized, and air is supplied to the air chambers 57. In this state, the sheet 19 is moved in the axial direction along the outer circumference of the cylinder section 32 and the groove 40, and removed from the front end side of the cylinder section 32. The air supplied to the air chambers 57 flows outward from the air discharge holes 60, and the machine plate 2 formed in a cylindrical shape expands in the radial direction due to the pressure of the air, whereby the inner diameter of the machine plate 2 becomes larger than the outer diameter of the cylinder section 32, and the machine plate 2 can be readily removed from the cylinder section 32.

The inner diameter of the machine plate 2 to be manufactured can be adjusted through adjustment of the position of the diameter adjustment member 45. When the lower cylindrical surface of the diameter adjustment member 45 is rendered flush with the outer circumferential surface of the sheet mounting portion 35 or is retracted radially inward from that position, the machine plate 2 has an inner diameter determined by the outer diameter of the sheet mounting portion 35. When the diameter adjustment member 45 is caused to project outward beyond the outer circumferential surface of the sheet mounting portion 35, the inner diameter of the machine plate 2 becomes greater than the outer diameter of the sheet mounting portion 35, and the greater the projection amount, the greater the inner diameter of the machine plate 2.

The overall and component-level configurations of the printer, the machine-plate mounting device 3, and the machine plate 2 are not limited to those of the above-described embodiments and may be modified as appropriate.

For example, in the above-described embodiment, the welding head 33 is attached to the stand 31 via the moving bodies 62 and 63, and is automatically moved in response to a manual operation, whereby welding is performed. However, the embodiment may be modified such that a welding head is prepared separately from the machine-plate manufacturing device 30, and welding is manually performed. Further, in the case where the joint portion 20 of the machine plate 2 is not joined by means of welding, the plate-shaped electrode 39 is unnecessary.

INDUSTRIAL APPLICABILITY

The present invention is suitably applied to printer-machine-plate manufacturing devices. When a plate according to the present invention is used, a cylindrical printer machine plate can be readily manufactured.

The invention claimed is:

1. A printer-machine-plate manufacturing device for manufacturing a printer machine plate comprising:

a rectangular sheet of a magnetic material is formed into a cylindrical shape, wherein a cylinder section having an outer circumferential portion around which the sheet is wound and which has a groove into which an engagement portion of the sheet is removably inserted from its distal end, wherein, on the inner side of the outer circumferential portion of the cylinder section, a magnetic attraction member formed of a magnetic material is provided, and permanent magnets are provided in such a manner that orientation of the permanent magnets can be changed, and wherein permanent-magnet switching means is provided in order to switch the orientation of the permanent magnets between a magnetization position for magnetizing the magnetic attraction member and a demagnetization position for demagnetizing the magnetic attraction member, wherein the cylinder section has a columnar portion with at least two opposing projections so that the at least two opposing projections is: a first opposing projection defining a first axial groove for receiving a plate-shaped electrode for spot welding the sheet and the plate shaped electrode defines a second axial groove for receiving an inwardly bent engagement portion of the sheet; and a second opposing projection defining a third axial groove for receiving a diameter adjustment member and the diameter adjustment member includes a rectangular body with at least two radial holes having adjustment screws that threadably engage the radial holes to press against the second opposing projection and thereby selectively move the rectangular body radially inward and outward to selectively vary the outer circumference.

2. A printer-machine-plate manufacturing device according to claim 1, wherein a plate-shaped electrode for spot welding is provided in the outer circumferential portion of the cylinder section at a position corresponding to the joint portion of the sheet wound around the cylinder section with the engagement portion fitted into the groove.

3. A printer-machine-plate manufacturing device according to claim 2, wherein a welding head which has a bar-shaped electrode for spot welding and which can move in relation to the plate-shaped electrode at least in the radial direction and axial direction of the cylinder section is provided at a position located radially outward of the plate-shaped electrode for spot welding.

4. A printer-machine-plate manufacturing device according to claim 1, wherein a diameter adjustment member is provided in the outer circumferential portion of the cylinder section such that the diameter adjustment member selectively moves to points between and including an inward position where the diameter adjustment member sinks fully inward under the outer circumferential surface of the cylinder section to minimize a diameter of the cylinder section and an outward position where the diameter adjustment member projects outward beyond the outer circumferential surface to maximize the diameter.

5. A printer-machine-plate manufacturing device according to claim 1, wherein the cylinder section defines an air chamber; the cylinder section and the magnetic attraction member define air discharge holes communicating with the air chamber that have outlets in the outer circumferential portion of the cylinder section at a plurality of locations in the axial direction and circumferential direction of the cylinder section; and air supply means is provided so as to supply air to the air chamber for easy release of the cylinder.

6. A printer-machine-plate manufacturing device according to claim 2, wherein a diameter adjustment member is provided in the outer circumferential portion of the cylinder section such that the diameter adjustment member can move between a position where the diameter adjustment member sinks inward under the outer circumferential surface of the cylinder section and a position where the diameter adjustment member projects outward beyond the outer circumferential surface.

7. A printer-machine-plate manufacturing device according to claim 3, wherein a diameter adjustment member is provided in the outer circumferential portion of the cylinder section such that the diameter adjustment member can move between a position where the diameter adjustment member sinks inward under the outer circumferential surface of the cylinder section and a position where the diameter adjustment member projects outward beyond the outer circumferential surface.

8. A printer-machine-plate manufacturing device according to claim 2, wherein an air chamber is formed within the cylinder section; air discharge holes communicating with the air chamber are formed in the outer circumferential portion of the cylinder section at a plurality of locations in the axial direction and circumferential direction of the cylinder section; and air supply means is provided so as to supply air to the air chamber.

9. A printer-machine-plate manufacturing device according to claim 3, wherein an air chamber is formed within the cylinder section; air discharge holes communicating with the air chamber are formed in the outer circumferential portion of the cylinder section at a plurality of locations in the axial direction and circumferential direction of the cylinder section; and air supply means is provided so as to supply air to the air chamber.

10. A printer-machine-plate manufacturing device according to claim 6, wherein an air chamber is formed within the cylinder section; air discharge holes communicating with the air chamber are formed in the outer circumferential portion of the cylinder section at a plurality of locations in the axial direction and circumferential direction of the cylinder section; and air supply means is provided so as to supply air to the air chamber.

11. A printer-machine-plate manufacturing device according to claim 7, wherein an air chamber is formed within the cylinder section; air discharge holes communicating with the air chamber are formed in the outer circumferential portion of the cylinder section at a plurality of locations in the axial direction and circumferential direction of the cylinder section; and air supply means is provided so as to supply air to the air chamber.

12. A printer-machine-plate manufacturing device for manufacturing a printer machine plate configured such that a rectangular sheet of a magnetic material having elasticity is formed into a cylindrical shape with opposite end portions of the sheet superposed on each other and joined together to form a joint portion whereby a cylindrical machine-plate body is formed; an end portion of the sheet located on the inner side of the joint portion is bent inward whereby an engagement portion is formed; and a formed area is provided at a predetermined portion of the outer circumferential surface of the machine-plate body excluding the joint portion, the manufacturing device comprising:

an elongated cylinder section having: an outer circumferential portion extending along an axis for winding the sheet around; and a groove for removably receiving the engagement portion of the sheet;

a magnetic attraction member formed of a magnetic material mounted on an inner side of the outer circumferential portion of the cylinder section; and a permanent magnet rotatably mounted in the magnetic attraction member, the permanent magnet having a knob for rotating the permanent magnet between a magnetization position for magnetizing the magnetic attraction member to magnetically hold the cylindrical machine-plate body to the elongated cylinder section and a demagnetization position for demagnetizing the magnetic attraction member to release the cylindrical machine-plate body from the elongated cylinder section, wherein the cylinder section has a cylindrical columnar portion with at least two opposing projections such that the at least two opposing projections is: a first opposing projection defining a first axial groove for receiving a plate-shaped electrode for spot welding the sheet; and a second opposing projection defining a third axial groove for receiving a diameter adjustment member and the diameter adjustment member includes a rectangular body with at least two radial holes having adjustment screws that threadably engage the radial holes to press against the second opposing projection and thereby selectively move the rectangular body radially inward and outward to selectively vary the outer circumference.

13. A device for manufacturing a printer machine plate comprising:

a cylinder section having: a cylindrical columnar portion along a central axis; at least two opposing projections extending from the cylindrical columnar portion; at least one arcuate attraction member extending between the at least two opposing projections and defining an axial passage; and a pair of opposing semicylindrical halves surrounding and supported by the at least two opposing projections and at least one arcuate attraction member to form an outer circumference with the at least two projections; and at least one switching assembly including: a central shaft; a plurality of permanent magnets mounted on the central shaft so that magnetic poles are formed on opposite sides of a plane passing through the central shaft; a plurality of spacers mounted on the central shaft between each pair of permanent magnets; and a knob mounted on one end of the shaft, wherein the at least one switching assembly is mounted in the axial passage for selective rotational movement within the axial passage between: a magnetization position that magnetizes the one arcuate attraction member for magnetically holding the sheet to the cylinder section; and a demagnetization position that demagnetizes the one arcuate attraction member that releases the sheet from being held by the cylinder section, wherein the at least two opposing projections is: a first opposing projection defining a first axial groove for receiving a plate-shaped electrode for spot welding the sheet and the plate shaped electrode defines a second axial groove for receiving an inwardly bent engagement portion of the sheet; and a second opposing projection defining a third axial groove for receiving a diameter adjustment member and the diameter adjustment member includes a rectangular body with at least two radial holes having adjustment screws that threadably engage the radial holes to press against the second opposing projection and thereby selectively move the rectangular body radially inward and outward to selectively vary the outer circumference.

14. A device as recited in claim 13, wherein the cylindrical columnar portion defines a central axial air hole and radial communication holes extending from the central air hole, and the pair of opposing semicylindrical halves define a plurality of radial discharge holes 60, and further comprising a forced air supply for providing compressed air to the central air hole for release from the radial discharge holes for easy removal of the sheet from the cylinder section.

15. A printer-machine-plate manufacturing device for manufacturing a printer machine plate, the manufacturing comprising:

a cylinder section having an outer circumferential portion, wherein on the inner side of the outer circumferential portion of the cylinder section, magnetic attraction members formed of a magnetic material are provided, and permanent magnets are provided in such a manner that their position can be switched, and wherein permanent-magnet switching means is provided in order to switch the position of the permanent magnets between a magnetization position for magnetizing the magnetic attraction member and a demagnetization position for demagnetizing the magnetic attraction member, wherein the outer circumferential portion has a groove into which an engagement portion of a sheet that is wound around the outer circumferential portion is removably insertable from its distal end, and said permanent magnet switching means comprises a support shaft extending in the frontrear direction of the cylinder section, and a knob fixed at a front end portion of the support shaft projecting frontward from the front end wall member of the cylinder section, the permanent magnets having the form of a short cylindrical column and being rotatably supported between grooves of the magnetic attraction members, said permanent magnets being concentrically fixed to the support shaft, wherein the cylinder section has a cylindrical columnar portion with at least two opposing projections such that the at least two opposing projections is: a first opposing projection defining a first axial groove for receiving a plate-shaped electrode for spot welding the sheet; and a second opposing projection defining a third axial groove for receiving a diameter adjustment member and the diameter adjustment member includes a rectangular body with at least two radial holes having adjustment screws that threadably engage the radial holes to press against the second opposing projection and thereby selectively move the rectangular body radially inward and outward to selectively vary the outer circumference.

16. A printer-machine-plate manufacturing device for manufacturing a printer machine plate comprising:

a rectangular sheet of a magnetic material is formed into a cylindrical shape, a cylinder section having an outer circumferential portion around which the sheet is wound and which has a groove into which an engagement portion of the sheet is removably inserted from its distal end, wherein, on the inner side of the outer circumferential portion of the cylinder section, a magnetic attraction member formed of a magnetic material is provided, and permanent magnets are provided in such a manner that orientation of the permanent magnets can be changed, and wherein permanent-magnet switching means is provided in order to switch the orientation of the permanent magnets between a magnetization position for magnetizing the magnetic attraction member and a demagnetization position for demagnetizing the magnetic attraction member, and when the permanent magnets are in the demagnetization position, the magnetic poles of each permanent magnet are arranged in the radial direction of the cylinder section and when the permanent magnets are in the magnetization position, the magnetic poles of each permanent magnet are arranged in the circumferential direction of the cylinder section, wherein the cylinder section has a cylindrical columnar portion with at least two opposing projections such that the at least two opposing projections is: a first opposing projection defining a first axial groove for receiving a plate-shaped electrode for spot welding the sheet; and a second opposing projection defining a third axial groove for receiving a diameter adjustment member and the diameter adjustment member includes a rectangular body with at least two radial holes having adjustment screws that threadably engage the radial holes to press against the second opposing projection and thereby selectively move the rectangular body radially inward and outward to selectively vary the outer circumference.

* * * * *